US005839085A

United States Patent [19]

Yoshikawa et al.

[11] Patent Number: 5,839,085

[45] Date of Patent: Nov. 17, 1998

[54] SYSTEM AND METHOD FOR DETECTING VEHICLE TYPES BY UTILIZING INFORMATION OF VEHICLE HEIGHT, AND DEBITING SYSTEM UTILIZING THIS SYSTEM AND METHOD

[75] Inventors: Kazutoshi Yoshikawa, Toyota; Shuichi Sunahara, Aichi-ken, both of Japan

[73] Assignee: Toyota Jidosha Kabushiki Kaisha, Toyota, Japan

[21] Appl. No.: 781,048

[22] Filed: Jan. 9, 1997

[30] Foreign Application Priority Data

Jan. 10, 1996 [JP] Japan ..... 8-002237

[51] Int. Cl.[6] ..... G08G 1/08; G07B 15/02

[52] U.S. Cl. ..... 701/117; 340/933; 340/937; 340/942; 235/384; 235/375; 705/13

[58] Field of Search ..... 364/554; 701/32, 701/34, 37, 117; 705/13–14; 340/942, 933, 937; 235/384, 375

[56] References Cited

U.S. PATENT DOCUMENTS

| | | | |
|---|---|---|---|
| 4,789,941 | 12/1988 | Nunberg | 701/117 |
| 5,144,553 | 9/1992 | Hassett et al. | 705/13 |
| 5,160,971 | 11/1992 | Koshizawa | 342/72 |
| 5,204,675 | 4/1993 | Sekine | 340/933 |
| 5,392,034 | 2/1995 | Kuwagaki | 701/117 |
| 5,488,360 | 1/1996 | Ray | 340/933 |
| 5,528,234 | 6/1996 | Mani et al. . | |
| 5,546,188 | 8/1996 | Wangler et al. | 356/376 |
| 5,554,984 | 9/1996 | Shigenaga et al. | 340/933 |
| 5,602,375 | 2/1997 | Sunahara et al. | 235/384 |
| 5,617,086 | 4/1997 | Klashinsky et al. | 340/933 |

FOREIGN PATENT DOCUMENTS

| | | |
|---|---|---|
| 585718 | 3/1994 | European Pat. Off. . |
| 612050 | 8/1994 | European Pat. Off. . |
| 616 302 | 9/1994 | European Pat. Off. . |
| 4-034684 | 2/1992 | Japan . |
| 8-186534 | 7/1996 | Japan . |
| 8-293049 | 11/1996 | Japan . |

*Primary Examiner*—John E. Barlow, Jr.
*Assistant Examiner*—Brian Bui
*Attorney, Agent, or Firm*—Cushman Darby & Cushman IP Group of Pillsbury Madison & Sutro LLP

[57] ABSTRACT

A system and a method for detecting vehicle types utilizing height information and a debiting system using such a system or a method. A plurality of distance sensors (heads) are provided laterally on a road, and 0/1 linked existence data and linked height data are generated by a link generator. The former data represent the existence of a vehicle on a detection line drawn along the road width direction on the basis of the distance data obtained by the heads and the latter data represent height profiles of a vehicle on the detection line. Height data such as maximum, minimum and average height in every height block are calculated by a scan-by-scan height evaluator 38 on the basis of the linked height data and vehicle position information, and a vehicle type detector 40 detects the type of the vehicle. It is possible to accurately detect illegal vehicles, which have an ID corresponding to another vehicle type, by transmitting the results to the host system together with the output of a vehicle detector and using a detection result.

21 Claims, 14 Drawing Sheets

Fig. 10(a)
0/1 LINKED EXISTENCE DATA
Fig. 10(b)
LINKED HEIGHT DATA GATED BY 0/1 LINKED EXISTENCE DATA
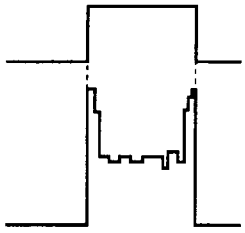
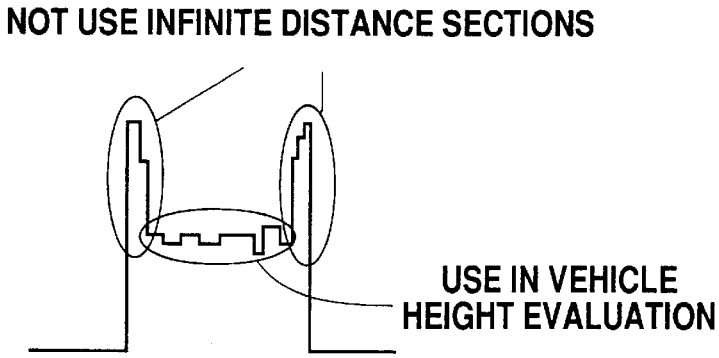
Fig. 11
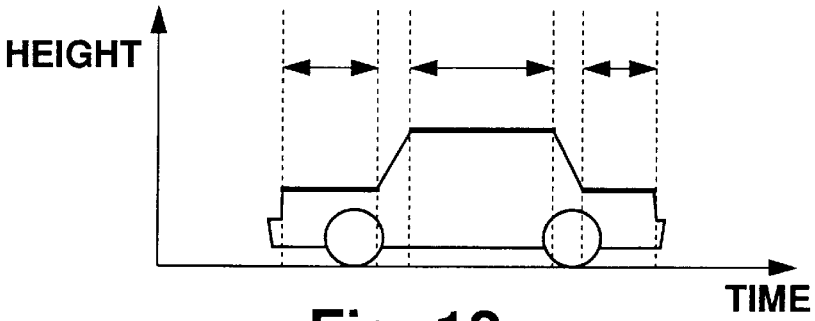
Fig. 12
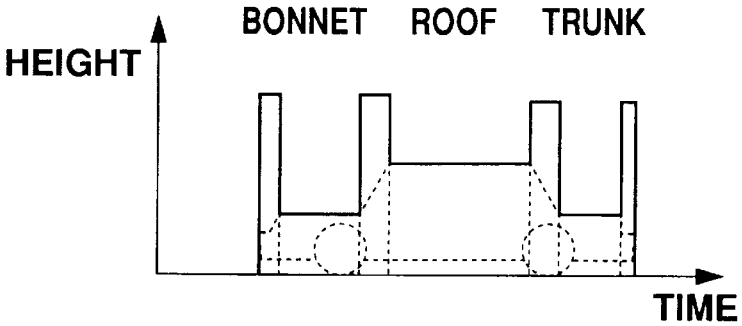
Fig. 13

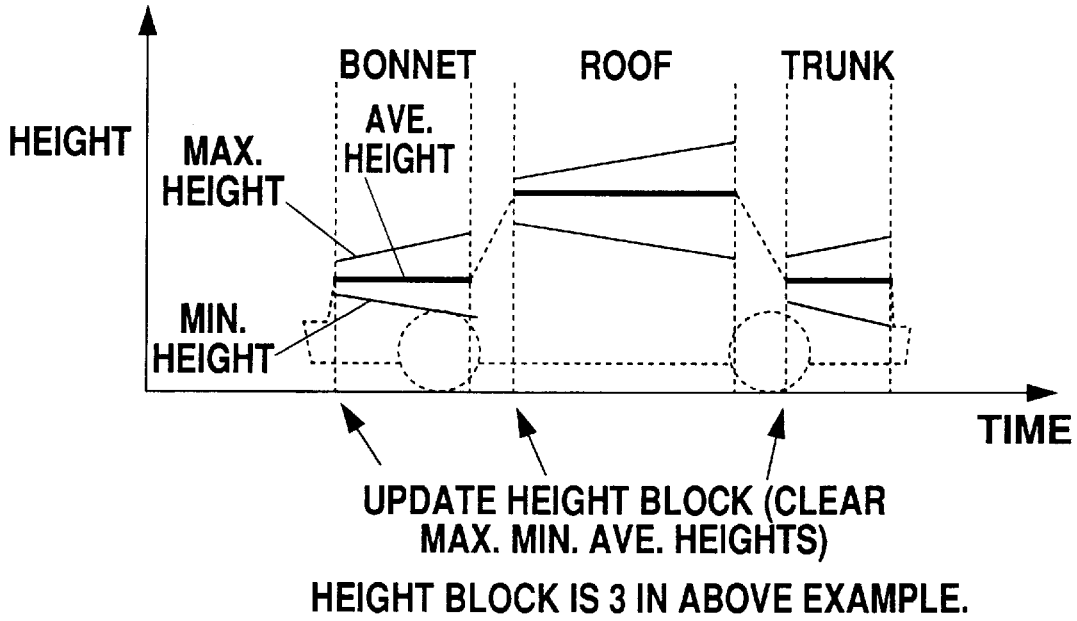
Fig. 14
Fig. 15(a)
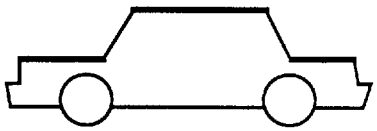
⇒ PASSENGER CAR (THREE-BOX)
Fig. 15(b)
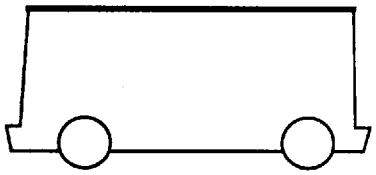
⇒ ONE-BOX, BUS
Fig. 15(c)
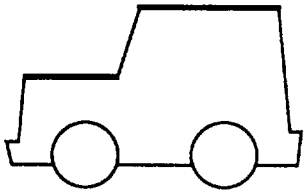
⇒ TWO-BOX, 4WD
Fig. 15(d)
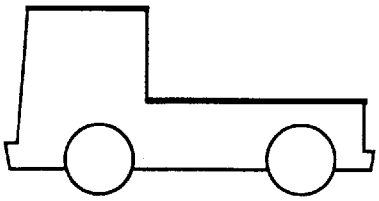
⇒ TRUCK

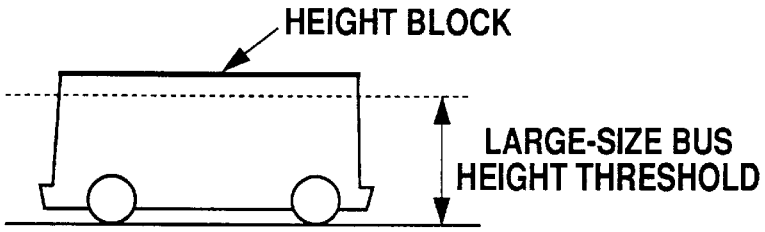
Fig. 19
Fig. 20(a)
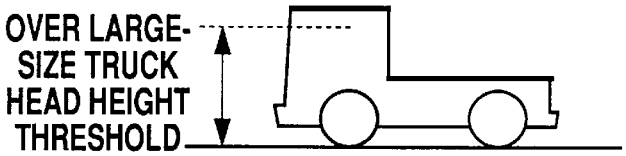
NO LOAD
Fig. 20(b)
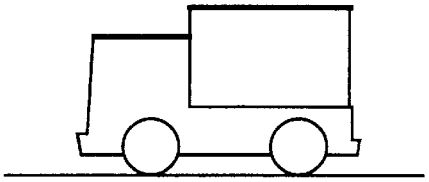
LOAD COVERED
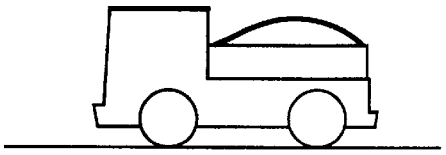
DUMP CAR (CARRYING GRAVEL)
Fig. 20(c)
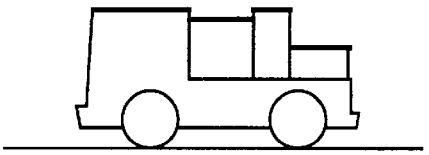
VARIOUS LOADS
Fig. 20(d)

SYSTEM AND METHOD FOR DETECTING VEHICLE TYPES BY UTILIZING INFORMATION OF VEHICLE HEIGHT, AND DEBITING SYSTEM UTILIZING THIS SYSTEM AND METHOD

BACKGROUND OF THE INVENTION a) Field of the Invention

The present invention relates to a vehicle type detecting system and method for detecting types of vehicles travelling on a road and to a debiting system utilizing such a system and method.

b) Description of the Prior Art

The vehicle type detecting system disclosed in Japanese Patent Laid-open Pub. No. Hei 4-34684 has an optical sensor directed toward a crossing direction of a road, and means for detecting the existence of an overhang (a front extension of a vehicle) of a passed vehicle on the basis of an output signal from this optical sensor. However, this prior art system has several problems.

The first problem is a restriction on applicable environments. According to the disclosure of the publication, in order to detect the existence of the overhang, it is necessary to control the passage of vehicles so that only one vehicle passes in front of the optical sensor at a time. The means shown in the publication is a toll gate for restricting vehicles so that only one vehicle passes at a time. However, if the toll gate is installed on a road, a traffic jam easily occurs. Because such means for controlling passage of vehicles so as to pass one by one in front of the toll gate without the occurrence of a traffic jam is not yet known, applicable conditions of the prior art are limited practically and essentially to a special environment in which the toll gate can be installed without the occurrence of a traffic jam.

The second problem is poor performance of discriminating vehicle types. That is the to say, since in principle, the prior art system can detect only the existence of the overhang the discrimination of a sedan and a light van, both of which have the overhangs on a front side of a body and the discrimination of a bus and a trailer, both of which do not have the overhang on a front side, can not be performed by the prior art system.

SUMMARY OF THE INVENTION

One object of the present invention is to enable detection of the vehicle types of respective vehicles in the case where a plurality of vehicles freely travel on a multilane road, by the improvement and application of remote sensing technology. Another object of this invention is to enable detection of various vehicle types, which are increasing more and more at present, by the remote sensing of vehicle height.

According to a first aspect of the present invention, firstly, the height of an object on a road is detected. Secondly, when the detected height satisfies at least one of the vehicle type conditions defined for each vehicle type, the object is identified as a vehicle which belongs to that vehicle type corresponding to the satisfied vehicle type condition or conditions. Because the vehicle detection and the vehicle type detection performed in this way are based on the information of height, the first aspect of the present invention can be applied to multilane roads. Further, when the detected height does not satisfy either of the vehicle type conditions, it is preferably determined that the object is not a vehicle.

According to a second aspect of the present invention, firstly, the height profile of the object on the road is detected along the direction crossing the lengthwise direction of the road repeatedly so as to get a plurality of height profiles with respect to the same object. Secondly, a pattern of the variation of a plurality of height profiles along the lengthwise direction of the road is detected. Then, if the above-mentioned pattern satisfies at least one of the vehicle type conditions, the object is identified as a vehicle which belongs to that vehicle type corresponding to the satisfied vehicle type condition or conditions. Because the information of height is utilized as in the first aspect, the effects similar to those in the first aspect are also obtained in the second aspect. In addition, because the variation of the height profile of a vehicle running on a road represents a particular and inherent pattern of each vehicle type in general, it is possible to identify the vehicle type more finely and accurately than the first aspect, by performing identification based on the pattern of variation of the height profile is made.

The following mode can exemplify a preferred embodiment of the second aspect of the present invention.

In the first preferred embodiment, firstly, a statistical index representing the distribution of the height in the object is generated for each of a plurality of height profiles. Secondly, patterns of variation of the height profiles in the same object along the lengthwise direction of the road are detected by comparing the generated statistical indexes to each other along the lengthwise direction of the road. The comparison of the statistical indexes enable the detection of the position of the border of the iso-height block of the vehicle (in the present application, each of portions having different heights like a bonnet, a roof, etc.), the number of iso-height blocks constructing the same vehicle, the difference in height between the iso-height blocks, and so on. Consequently, according to the present embodiment, it is possible to classify the patterns of variation of the height profiles exactly, and vehicle type detection can be performed more accurately.

In the second preferred embodiment, firstly, height profiles which are detested from those beyond the range of a height detection limit are contained in a plurality of the height profiles detected from the same object. Secondly, the pattern of variation of the height profiles along the lengthwise direction of the road is detected by distinguishing the number of the height profiles which are beyond the range of the height detection limit. By detecting the height profiles which are beyond the range of the height detection limit in this manner, it is possible to classify the pattern of the variation of the height profiles exactly and to detect the vehicle type accurately, as in the first embodiment. In addition, the vehicle type detection will become even more accurate by combining the present embodiment and the first embodiment.

To implement the second aspect, a plurality of sensors for detecting the distance to the object passing nearby may preferably be arranged beforehand so as to make a line with a required small interval along the direction crossing the lengthwise direction of a road. In the case of the actual application, the height profile is detected by utilizing the results detected by the plurality of sensors. If any of the sensors is out of order, the information representative of an estimated distance or height is generated by using the results detected by another sensor arranged in the proximity of the faulty sensor and is utilized instead of the distance to be detected by the faulty sensor. Therefore, in the present embodiment, even when any of the sensors goes out of order, the problem of the sensor does not greatly affect the later processing of the information, because the information to be detected by the faulty sensor is supplemented at least partially by the output from another sensor. Further, frequency of maintenance of the sensors can be suppressed, and a load for an operator of the system is reduced. In addition, because these advantages can be implemented by adding processing procedures, it is not necessary to provide redundant sensors, and the present embodiment contributes to the compactness of the system structure and the cost reduction.

Further, the first and the second aspects can be understood and represented as a system for vehicle type detection or a method for vehicle type detection.

According to a third aspect of the present invention, there is provided a debiting system comprising: a debiting or debiting confirmation system for identifying the vehicle type of the vehicle running on a road on the basis of the identification information received from the vehicle by radio communication; a vehicle type detection system according to the first or the second aspect of the present invention discussed above; and a host system for detecting the vehicle, which has transmitted the identification information different from the identification information of the actual vehicle type, by receiving at least the information concerning vehicle type from the debiting system or the debiting confirmation system and the vehicle type detecting system respectively, and by matching both information. In the present aspect, the first vehicle type information (e.g., ID) obtained from the debiting system or the debiting confirmation system and the second vehicle type information obtained from the vehicle type detection system are compared with each other, and the vehicle in which both information do not coincide is detected. Because the results of vehicle type detection by the vehicle type detection equipment in the present aspect are more accurate than those of the automatic debiting system disclosed in Japanese Patent Application No. Hei 7-82523 and U.S. Pat. No. 5,602,375 corresponding to the former (called "previously proposed system" later) filed by the assignee of the present application, various types of illegal vehicles for normal debiting including vehicles having improper ID can be detected more accurately and easily compared with the previously proposed system.

Differences between the aspects of the present inventions and the previously proposed system, especially differences between the principles of vehicle type detection, will now be explained.

Firstly, the debiting according to the present aspect means operates by charging the fee for a toll road to the account of the driver or the IC card on board the vehicle, or for settling it using electronic cash. Next, the debiting confirmation according to the present aspect means the confirms, just before or after debiting, whether or not the account or the IC card has a sufficient balance to pay, or confirms, at the time when the debiting should have been done, whether or not the debiting has actually been finished. These debiting and debiting confirmation operations are adopted already in the previously proposed system. In the previously proposed system, first, solicitation with an unspecified destination is executed to debit every passing vehicle, by using a debiting antenna arranged over the road. Every vehicle is given an ID beforehand for specifying the vehicle, or the user or the owner of the vehicle, and further provided with an IU (in-vehicle unit) which responds to the solicitation from the debiting antenna by this ID. The debiting for the vehicle, or the user or the owner of the vehicle is performed by the debiting antenna side receiving the ID, on the one hand, and the IU side executing the writing of the debiting information to the IC card, on the other hand, through radio communication between the debiting antenna and the IU. The debiting confirmation is executed similarly through radio communication between the IU and the debiting confirmation antenna arranged over the road.

In the previously proposed system, the position of passing the crossing direction of the road, passing time, vehicle width, etc. are detected after or at the same time as the debiting and the debiting confirmation (vehicle detection). As for vehicle detecting methods, the following methods are proposed. A first method (a) includes a plurality of loop coils buried in the ground along the crossing direction of the road in a crossing row. When the inductance of any of these coils has changed, the vehicle is considered to have passed over the loop coils. A second method (b) includes lines having a white and black stripe pattern provided on the road surface along the crossing direction. When the disturbance of the image of this white and black stripe pattern has been detected by a line scanner arranged over the road, the vehicle is considered to have passed the position where the disturbance occurred. A third method (c) includes a plurality of distance sensors based on trigonometric survey provided over the road along the crossing direction of the road in a crossing row. When a finite distance different from the distance to the road surface has been detected, the vehicle is considered to have passed the position where the finite distance has been detected. Other methods are also applicable. Because all of these vehicle detecting methods a) to c) are capable of preparing the information about the vehicle width, all of the problems in Japanese Patent Laid-Open Publication No. Hei 4-34684 can be solved. Among these methods, the method c) has merits such as not requiring the construction for burying the loop coils in the first ground like the method a) furthermore it is hardly affected by shadows and is excellent in terms of the resolution in the crossing direction of the road, relative to the method b).

In the previously proposed system, illegal vehicle detection is executed by matching the vehicle detecting information and the vehicle type information, which are obtained by vehicle detection and vehicle type detection, with the communication information, such as an ID which is obtained through debiting and debiting confirmation. By this matching, it is possible to detect, for example, a vehicle passing the road without debiting and/or debiting confirmation (no-ID vehicle, etc.), a vehicle which ought to be an ordinary vehicle according to ID but a large size vehicle according to vehicle detecting information (improper ID holding vehicle), etc. Images of number plates of no-ID vehicles, improper ID holding vehicles, vehicles having a remainder shortage, etc. are sent to the host system together with vehicle detecting information and communication information.

However, vehicle type detection on the basis of vehicle width detected by the methods a) to c) have some limitations for improving accuracy of vehicle type detection. For example, let us consider the case where method c) is executed by utilizing the distance sensors constituting an optical trigonometrical survey system as a distance sensor, as shown in the figures after FIG. 41 in Japanese Patent Application No. Hei 7-82523. In this case, if the received intensity of reflected light is low, it is not possible to distinguish whether the vehicle is passing or not. In other words, as for the circumstances of low received intensity of reflected light, there are circumstances in which the reflected light is greatly attenuated very much because the light from the light source of the sensor is reflected at an object located such a long way away as can practically be considered an infinitely long distance away from the light source (for example, at the bottom of a hole on a road surface). The circumstances includes these in which direction of the reflected light can not be received by the light receiving part of the sensor because the light from the light source is reflected at a body located at very short distance from the light source (for example, in the case of a very high vehicle), and the circumstances in which the light from the light source is refracted or reflected at parts having low reflectance such as windows and black bumpers, and at optical parts such as lenses of grille stop lamps, and others. It can not be determined by the received light intensity alone which of these three is the cause of insufficient received intensity. Consequently, it is impossible to detect the vehicle width accurately, and vehicle type detection based on the vehicle width is made inaccurate.

In the present invention, this kind of problem produced by the method c) does not occur. Even if results of height detection for any part of an object, for example, a vehicle running on a road, show the value beyond the height detection limit, height detection in any other part of the vehicle can be performed in the ordinary way. Accordingly, vehicle type detection can be executed finely and accurately by simply omitting the detected value beyond the height detection limit from the base for vehicle type detection. Further, finer and more accurate vehicle type detection becomes possible according to the given vehicle type detecting conditions. In addition, the height detecting means applicable to the present invention is not limited to optical distance sensors for detecting the distance by trigonometrical survey. However, if this type of sensor is adopted as in the method c), by adopting the first preferred embodiment of the second aspect as a method for vehicle type detection at the same time and by coping strictly in this way with such phenomena that received intensity of reflected light becomes low according to the position of the vehicle, accuracy of vehicle type detection becomes even more accurate. In addition, because the only modification of the processing procedures in the previously proposed system without adding any sensors is sufficient for applying the third aspect, composition of the system necessary for the application becomes simple and low-priced.

BRIEF DESCRIPTION OF THE DRAWINGS

FIG. 10 is a diagram showing 0/1 linked existence data at a detected vehicle position and linked height data gated by this 0/1 linked existence data.

FIG. 11 is a schematic diagram showing a part to be used and a part not to be used in principle for vehicle height evaluation from linked height data shown in FIG. 10.

FIG. 12 is a timing chart showing portions of a vehicle where most linked height data are not infinity data.

FIG. 13 is a timing chart showing portions of a vehicle where most linked height data are infinity data.

FIG. 14 is a timing chart showing height block edge timing detected as linked height data, most of which are infinity data.

FIG. 15 is a schematic diagram showing a difference between numbers of height blocks and a difference between heights of height blocks according to vehicle types, and showing a 3 box passenger car, a one box passenger car or bus, a 2 box passenger car or a 4 WD car, and a truck, in that order from the top.

FIG. 19 is a schematic diagram showing a principle for detecting a large size bus.

FIG. 20 is a schematic diagram showing a principle for detecting a large size truck.

DETAILED DESCRIPTION OF THE PREFERRED EMBODIMENTS a) Structure of Debiting System

Figure 1:
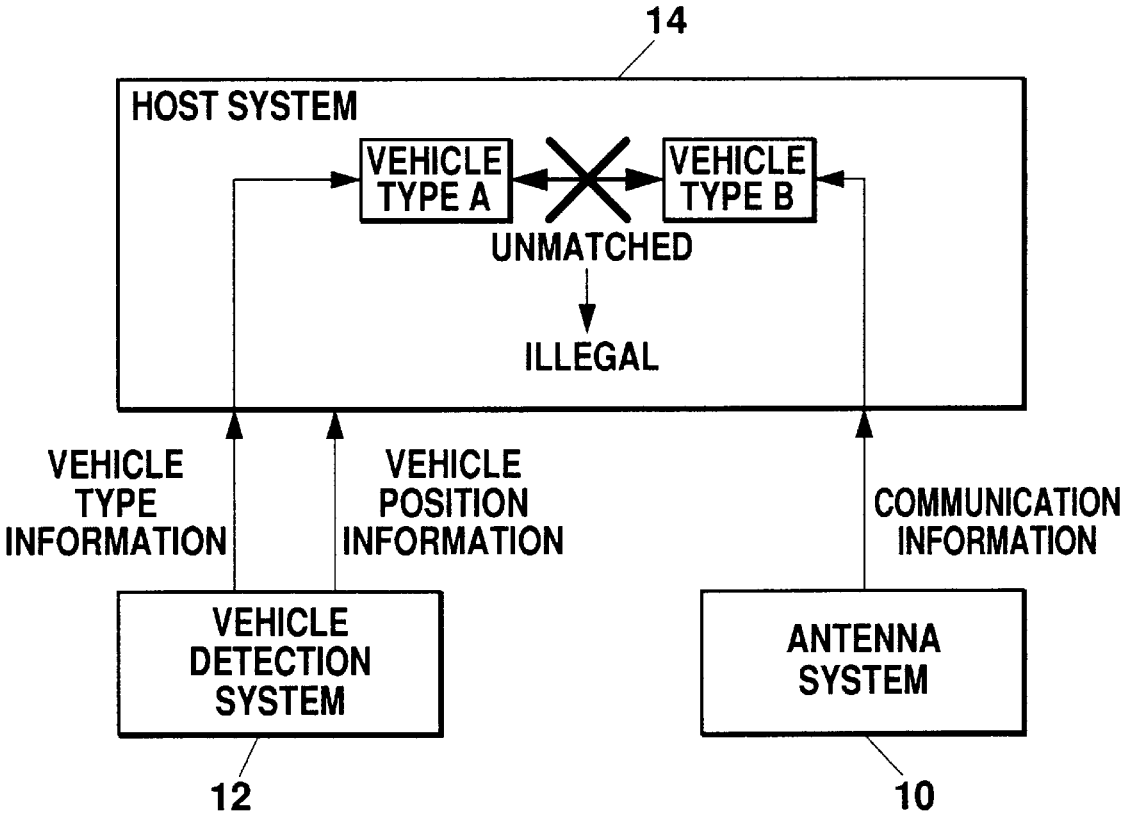
FIG. 1 is a block diagram showing an example of the configuration of an automatic debiting system according to an embodiment of the present invention.

FIG. 1 illustrates the structure of a debiting system according to one preferred embodiment of the present invention. The system comprises an antenna system 10, a vehicle detection system 12, and a host system 14. The antenna system 10 and the vehicle detection system 12 make a pair. In general, a plurality of pairs are provided at required points along a road which generally has a plurality of traffic lanes such that one pair is provided at one point. The antenna system 10 and the vehicle detection system 12 include a controller section which is generally provided beside a road and a communication/sensing section which is attached to a gantry spanning the road. The host system 14, connected to the antenna system 10 and the vehicle detection system 12 via a communication channel, collects information from them via the channel for processing.

More specifically, the antenna system 10 includes a plurality of debiting antennae and debiting confirmation antennae each attached to the gantry side by side, and a controller section for controlling communication by these antennae.

The controller section controls the debiting antennae so as to continuously or intermittently solicit an IU mounted on an unspecified vehicle passing below. As a vehicle approaches the gantry, the IU of that vehicle comes to be able to receive the solicitation from the gantry. Responding to the solicitation received, the IU starts communicating with the sender debiting antenna. Through this communication, a toll is debited for the IU, and the debiting antenna obtains an ID unique to that IU. Therefore, a debiting confirmation antenna confirms completion of proper toll debiting for every vehicle in the similar procedure. The antenna system 10, in particular its controller section, transmits the communication information obtained as a result of these operations to its host system 14. Since the information includes the ID of the vehicle concerned, the host system 14 can detect the type of that vehicle, that is, a vehicle from which a toll has been debited properly or improperly, by referring to the ID-to-vehicle type list based on the information received.

However, a debiting system comprising an antenna system 10 only suffers limitations in maintenance of fairness in toll debiting because such a system may allow the situation where a vehicle having no IU mounted thereto passes without paying a toll or a vehicle using an improper ID, such as one for a different type of vehicle, passes paying only an improper toll (for instance, a large-size vehicle uses an ID for an intermediate size vehicle to pass with a lower toll). A vehicle detection system 12 is a system for overcoming this deficiency. The system 12 remotely senses the position of a vehicle in the crossing direction of the road, the vehicle width, and other necessary information, and determines the vehicle type, based on the obtained information. The system 14 then sends the vehicle type information, along with the vehicle position information and other information, to its host system 14. The host system 14 compares the information from the antenna system 10 and that from the vehicle detection system 12, and detects illegal vehicles. For instance, when the vehicle detection system 12 detects the presence of a vehicle even though the antenna system 10 did not carry out debiting and debiting confirmation operations, the host system 14 decides that a vehicle without an IU mounted thereto has passed. Further, when the vehicle type which has been determined based on the information from the antenna system 10 does not coincide with the vehicle type information from the vehicle detection system 12, the system 14 knows that a vehicle carrying an improper ID number has passed. When an illegal vehicle is detected, the host system 14 takes necessary measures such as collecting an image showing a number plate of the illegal car from an enforcement camera (not shown) and registering a necessary black or gray list information in a data base. It should be noted that the information may be compared by a section other than a host system 14, such as a vehicle detection system 12.

The first characteristic feature of the present embodiment lies in the method of vehicle type detection by the vehicle detection system 12, that is, vehicle type detection utilizing height information, and improved accuracy and preciseness of vehicle type detection and reduced false-detection rate of illegal vehicles by means of that method.

b) Structure of Vehicle Detection System

Figure 2:
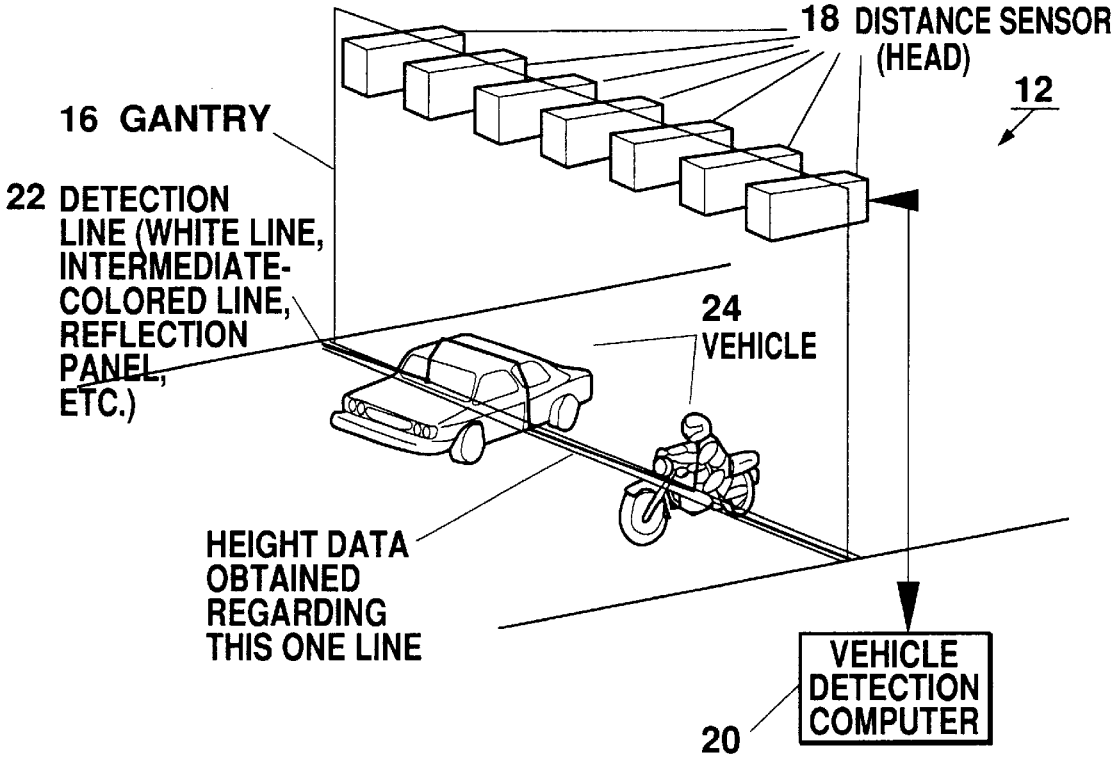
FIG. 2 is a schematic perspective view showing an example of the configuration of a vehicle detection system in the present embodiment.

As shown in FIG. 2, the vehicle detection system 12 comprises a plurality of distance sensors (hereinafter referred to as heads) each attached to a gantry 16 side by side and a vehicle detection computer 20 provided beside a road. Each of the heads 18 includes a plurality of measurement ports 42 (see FIG. 4). Each measurement port 42 consists of a pair of a light emission section and a light receiving section. The light emission section irradiates a light ray towards a detection line (a white line, an intermediate-colored line, a reflection panel, or the like) provided substantially directly under the gantry 16 in the crossing direction of the road, while the light receiving section receives light reflected from the direction of the detection line 22. The positional relationship between the light emission and receiving sections is set such that the distance therefrom to an object, such as a vehicle, on the detection line 22 can be triangulated. Since a plurality of heads 18 each consist of a plurality of measurement ports 42 as described above, it is possible to obtain distance information along the detection line 22 with high resolution. Further, the respective measurement ports 42 in the respective heads 18 operate at a different timing, that is, in a time-shared manner, so as to prevent competition among ports 42 during operation to thereby detect an accurate distance. Further, for prevention of competition among operating heads 18, the vehicle detection computer 20 or detection controller (not shown) controls the operating times of the respective heads 18 such that odd-numbered heads 18 operate in a different timing from even-numbered heads 18.

Figure 3:
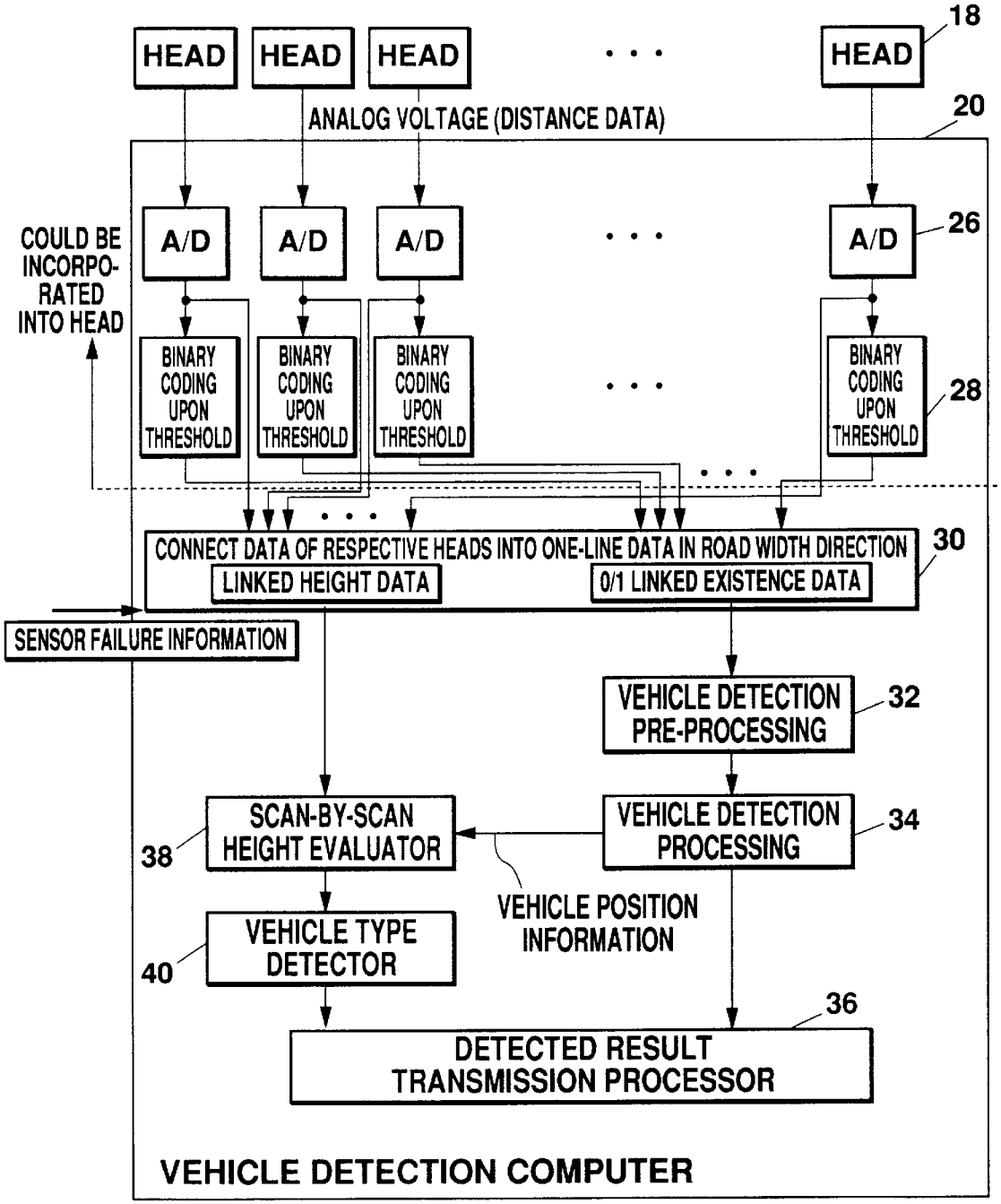
FIG. 3 is a block diagram showing a functional configuration of a vehicle detection computer.

As shown in FIG. 3, the vehicle detection computer 20 includes A/D converters 26 and binary coding sections 28 each corresponding to a head 18. Each A/D converter 26 converts a voltage output from its associated head 18, that is, an analog voltage corresponding to a distance from the head 18 to an object on the road, into a digital value, while each binary coding section 28 compares digitized distance data with a threshold for generation of 0/1 data indicating the presence or absence of a vehicle or an object. The A/D converter 26 and the binary coding section 28 may be incorporated into their associated head 18.

The vehicle detection computer 20 further includes a linkage generator 30 for connecting 0/1 data output from respective binary coding sections 28 to one another along the detection line 22 to thereby generate 0/1 linked existence data. The 0/1 linked existence data consists of bits including "1" bits at detected vehicle positions and "0" bits at other positions. A vehicle detection pre-processor 32, provided downstream of the linkage generator 30, conducts given pre-processing to 0/1 linked existence data prior to a vehicle detection operation. Based on the pre-processed 0/1 linked existence data, a vehicle detector 34 detects right and left edge positions, an average center position, the maximum, minimum, and average widths of a vehicle 24, and the time taken for the vehicle 24 to pass the detection line 22 (a passing time). The vehicle detector 34 supplies the thus obtained information to a detection result transmission processor 36 as vehicle detection information.

Further, the linkage generator 30 receives distance data in line from the A/D converter 26, wherein the distance data have been obtained through a single scanning operation by the heads 18 in line. The generator 30 then converts the data into height data, based on the distance from the head 18 to the road surface, and connects the respective height data in line to one another along the detection line 22 to thereby generate linked height data indicating a height profile of the vehicle 24 along the detection line 22. In this data generation, distance data based on receipt of insufficient light, including distance data based on the receipt of reflected light from an object at an infinite distance, is regarded as infinity data. The infinity data is handled in linked height data as data indicating infinite height (distance 0). A scan-by-scan height evaluator 38, provided downstream of the linkage generator 30, is supplied with linked height data from the linkage generator 30, and vehicle position information included in the vehicle detection information from the vehicle detector 34. Based on the information received, the evaluator 38 computes the maximum, minimum, and average heights of a vehicle 24 for every vehicle 24 for every scanning operation. A vehicle type detector 40, incorporated into the vehicle detection computer 20, detects a vehicle type, based on the information from the scan-by-scan height evaluator 38 to thereby generate vehicle type information. The detector 40 then supplies the generated vehicle type information to the detection result transmission processor 36. Having received vehicle detection information from the vehicle detector 34 and vehicle type information from the vehicle type detector 40, the detection result transmission processor 36 sends both information to the host system 14 via a communication channel.

Figure 4:
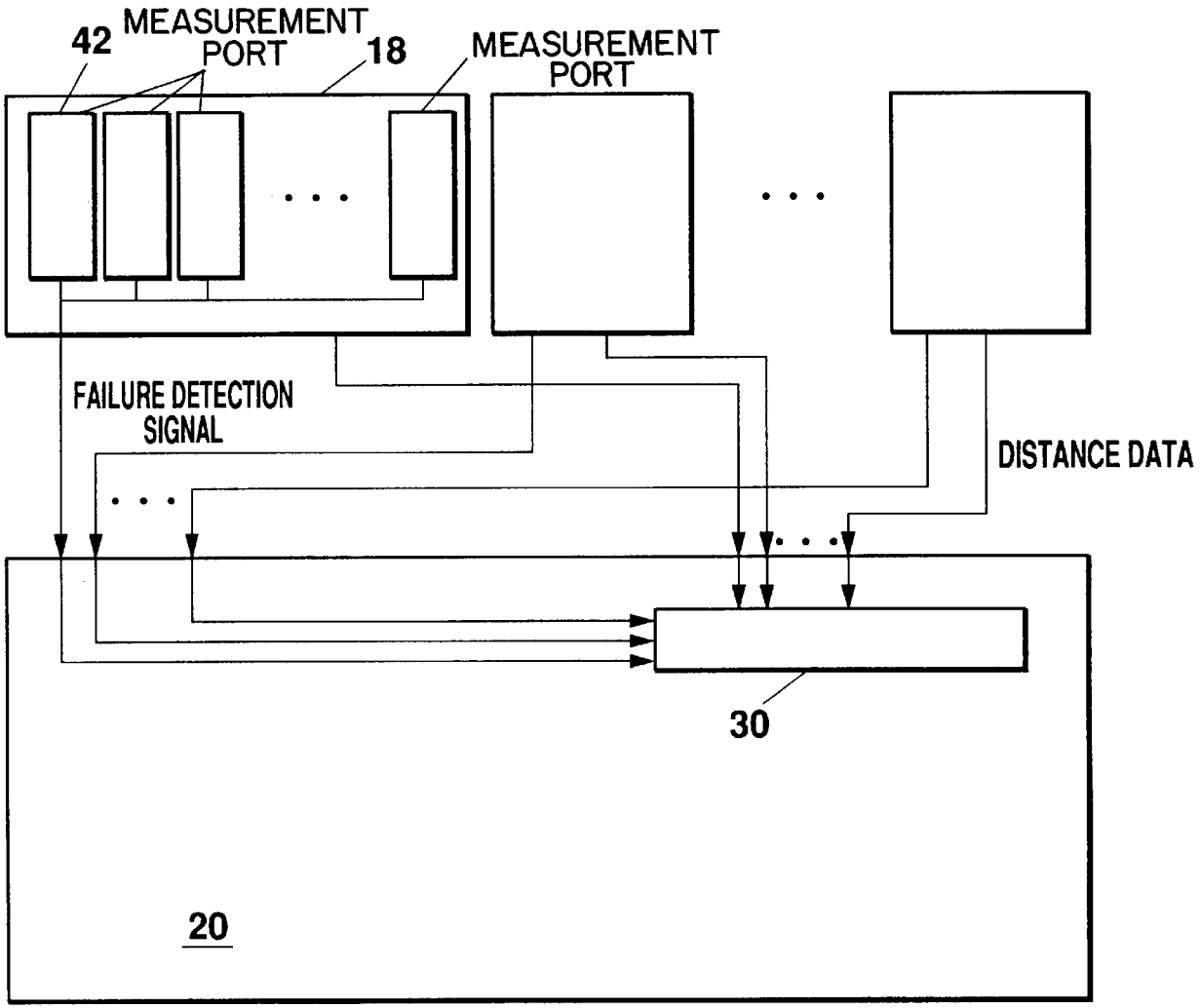
FIG. 4 is a block diagram showing contents of sensor failure information.

The vehicle detection computer 20 is further capable of modifying the operation of the linkage generator 30 according to a failure of respective measurement ports 42. Firstly, as shown in FIG. 4, when a failure occurs, the failure measurement ports 42 output a failure detection signal indicating that it has failed. A failure detection signal may be a signal indicating an irregular voltage or current of a light emission section and a light receiving section, in the case of using an LED (light emission diode) or a PSD (photo sensitive diode) as the port 42. Upon receipt of a failure detection signal as sensor failure information, the linkage generator 30 performs a head failure detection operation at generation of 0/1 linked existence data and linked height data. The second characteristic feature of the present invention lies in this head failure detection operation.

Figure 5:
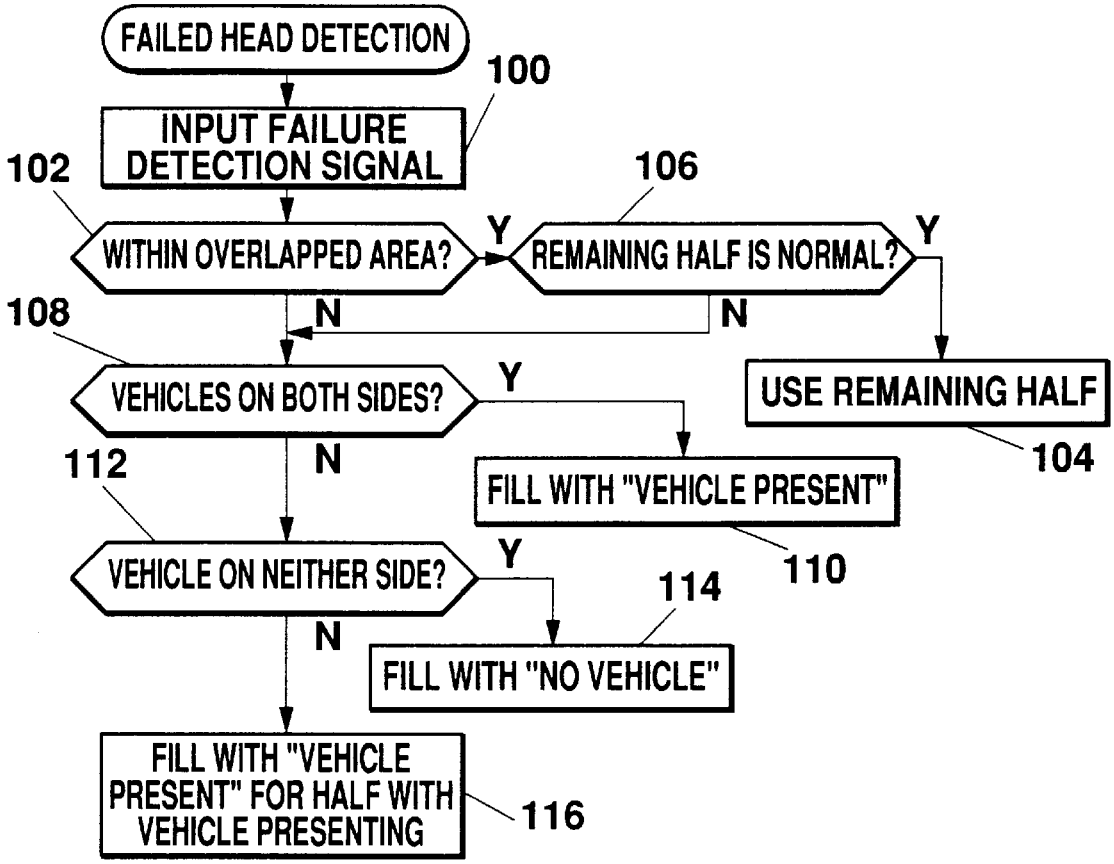
FIG. 5 is a flow chart showing a flow of head failure detection processing.

In the procedure shown in FIG. 5, the linkage generator 30 receives a failure detection signal (100), and judges whether or not the measurement port 42 which generated the signal is located within an overlapped area (102). Respective heads 18 are arranged such that their coverage in the detection line 22 direction are overlapped on each other in order to secure redundancy in detection. "An overlapped area" in step 102 means a part of the coverage in the detection line 22 direction of one head which is also covered by the coverage of another head 18. If the port 42 is in a coverage area, its failure can be compensated by another measurement port 42 which belongs to a different head responsible for partially the same coverage. Therefore, the linkage generator 30 utilizes 0/1 and distance data provided by the normal measurement port 42 of the different head so as to generate 0/1 linked existence data and linked height data relative to the failed point 42 (104).

Figure 6:
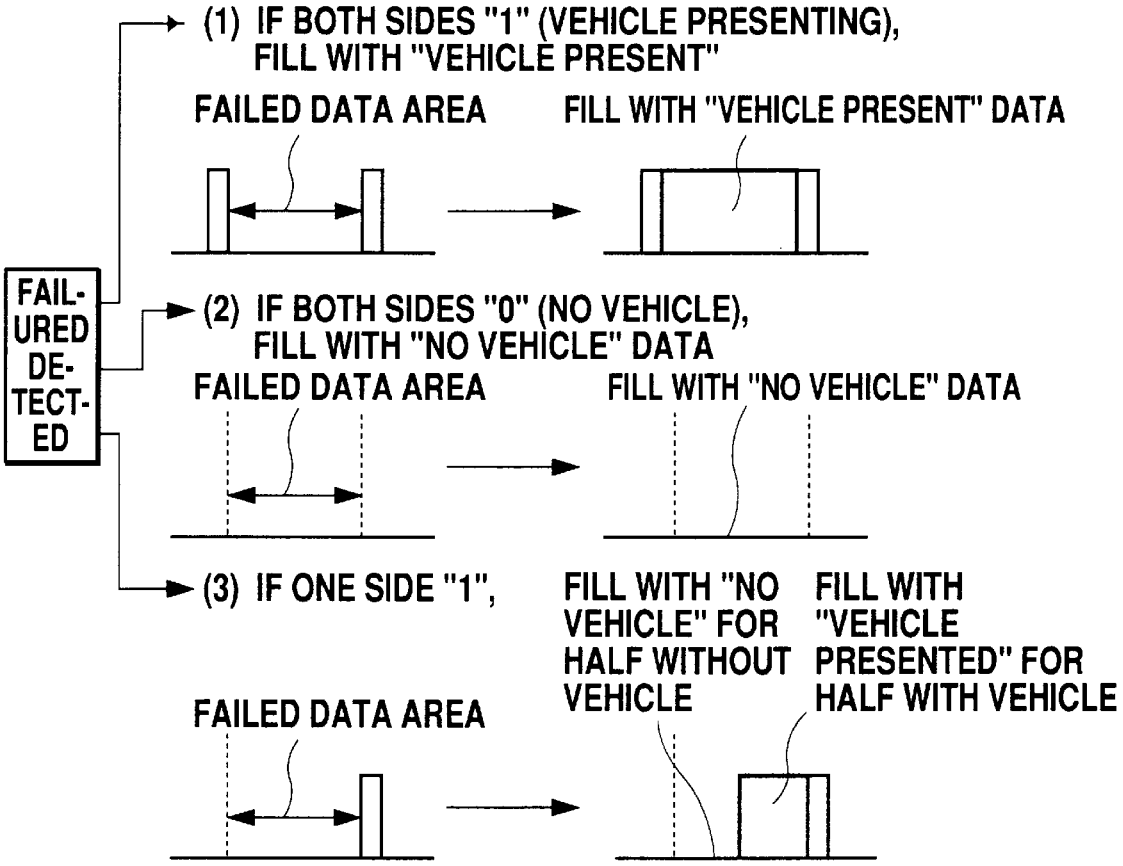
FIG. 6 is a schematic diagram showing contents of processing to be executed in the case where failure detection signal outputted from a measurement port is not in an overlapped area or although it is in an overlapped area, one remaining side is failed.

In cases of a measurement port 42 outside an overlapped area (102) or where both a measurement port 42 and another measurement port 42 both having partially the same coverage generate a failure detection signal (106), the aforementioned compensation method cannot be applied. In such a case, instead, the linkage generator 30 uses 0/1 and distance data of two, generally adjacent, measurement ports 42 so as to determine 0/1 and distance data which could have been obtained by utilizing the failed measurement ports 42 (108 to 116) using interpolation. Take as an example generation of 0/1 linked existence data. If the 0/1 data of two adjacent measurement ports 42 are both "1" (108), the 0/1 data of the failed measurement port 42 is also set as "1" (110, FIG. 6(1)). Whereas, if they are both "0" (112), the 0/1 data of the failed port 42 is also set as "0" (114, FIG. 6(2)). In other cases, that is, where one of the two adjacent ports 42 provides 0/1 data "1," while the other provides 0/1 data "0," the 0/1 data of the failed port 42 is set to be "1" for the half close to the "1" port 42, and "0" for the half close to the "0" port 42 (116, FIG. 6(3)).

With this arrangement, even if some of the measurement ports 42 fail, it is unlikely that the operation using 0/1 linked existence data and linked height data will be adversely affected, because the failure can be compensated as described above. Further, since the heads 18 need only occasional maintenance services when a significant number of measurement ports 42 have failed, a system operator will have a lower burden. In cases where a plurality of successive measurement ports 42 have failed simultaneously, normally operating measurement ports 42 on both sides of the failed point 42 row are used as "two adjacent measurement ports 42" in steps 108 to 116. In cases where one or more measurement ports at an end of the gantry 16 generate a failure detection signal or signals, the above step 114 is applied. As to distance data, similar compensation or interpolation is applicable.

c) Operation of Scan-by-scan Height Evaluator

The function relative to the first characteristic feature of the present embodiment is partly implemented by the foregoing scan-by-scan height evaluator 38, whose operation is shown in FIGS. 7 to 16.

Figure 7:
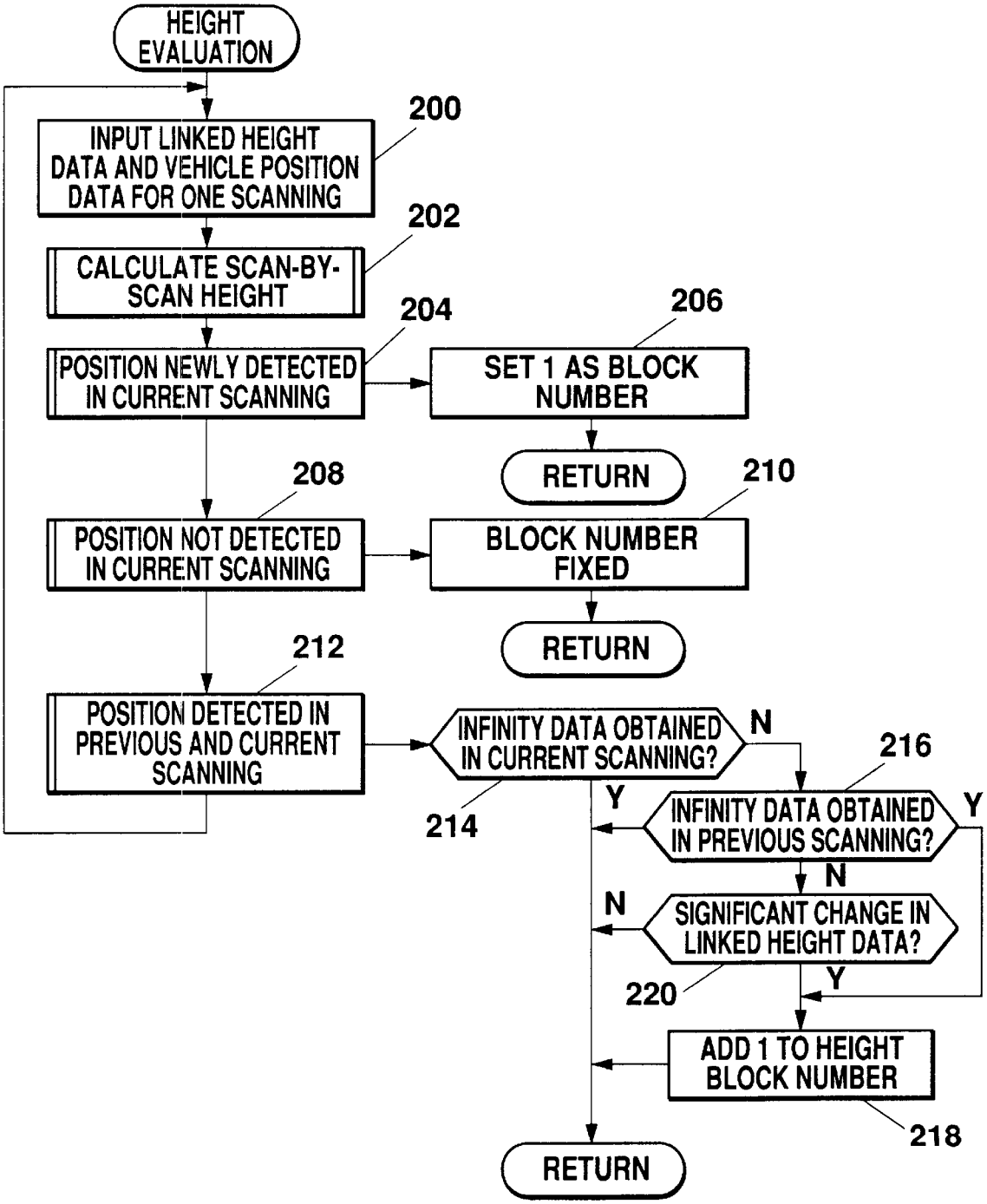
FIG. 7 is a flow chart showing a flow of scan-by-scan height evaluation processing.
Figure 8:
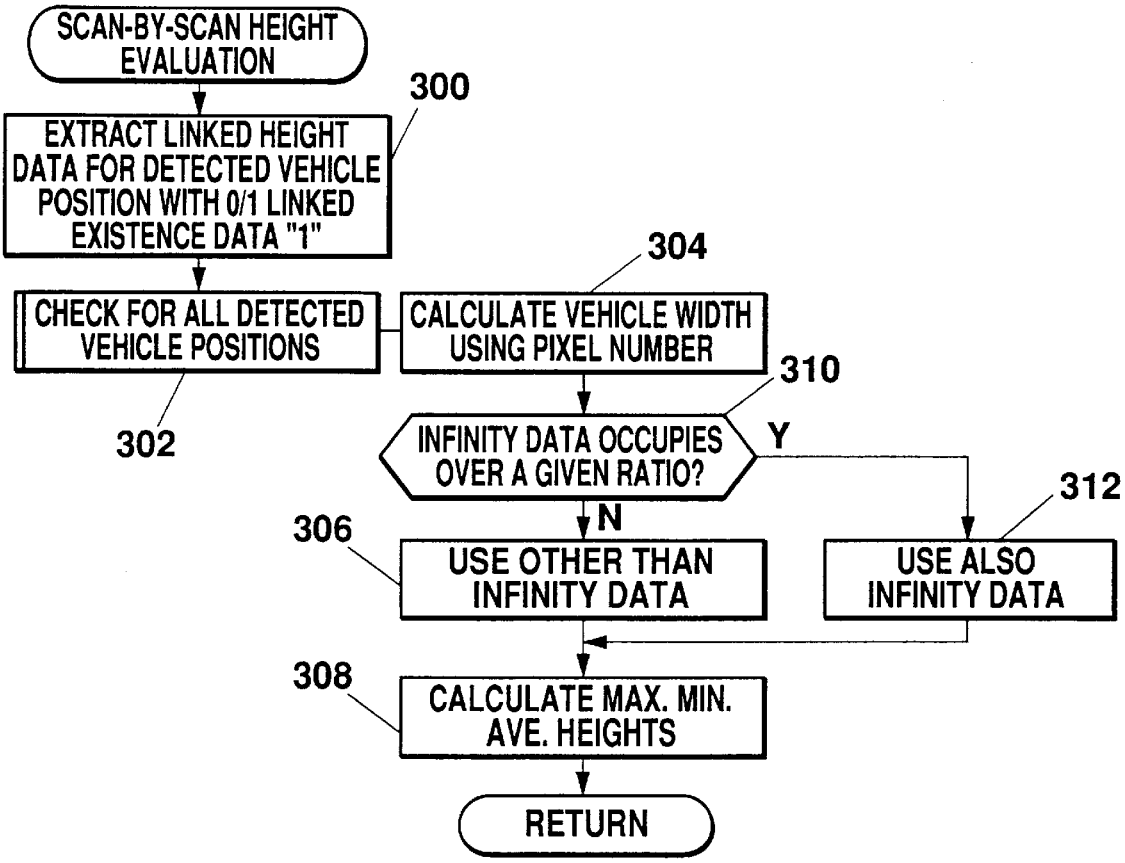
FIG. 8 is a flow chart showing a flow of scanned height evaluation processing.

In the operating procedure shown in FIG. 7, the scan-by-scan height evaluator 38 first receives 0/1 linked existence data and linked height data obtained through a single scanning operation (200). A single scanning operation means one execution of distance detection over the detection line 22 in cooperation with all of the heads 18. Based on the received data, the height evaluator 38 executes a scanned height evaluation routine concerning that scanning operation (202), as shown in FIG. 8.

In the scanned height evaluation routine, the height evaluator 38 gates linked height data by 0/1 linked existence data. That is, a pixel set consisting of a plurality of successive pixels whose 0/1 data are each "1" is extracted as an objective position from the 0/1 linked existence data received, and the values of linked height data in the objective position are extracted (300). The position in which respective 0/1 linked existence data are "1" is a position where an object is present which reflects a light ray from a measurement port 42 such that the port 42 receives the reflected light with significant light-intensity. Since this position can generally be regarded as a position where a vehicle is present, the operation at step 300 can provide a rough height profile of the vehicle 24 detected through the current scanning. In the present application, such a position is hereinafter referred to as a detected vehicle position. The scan-by-scan height evaluator 38 then separately extracts all detected vehicle positions (302), and detects widths thereof (corresponding to a vehicle width if the object is a vehicle 24), based on the number of pixels constituting respective positions (304). Assuming that the object (usually a vehicle 24) at the detected vehicle position is a three-box car, and that the roof thereof was transversely scanned in the current scanning, linked height data as to its window sections, as shown in the right half of FIG. 9, turn out to be infinity data shown in FIG. 10. The scan-by-scan height evaluator 38 calculates the maximum, minimum, and average heights of the object along the detection line 22, based on the linked height data (308) generally excluding infinity data (306), as shown in FIG. 11. However, in cases where infinity data occupies more than a given ratio with respect to the entire width calculated in step 304 (310), infinity data is also utilized for in step 308 (312).

After the scanned height evaluation routine is finished (202), the scan-by-scan height evaluator 38 performs updating and number-counting of height blocks for every detected vehicle position. For instance, as to a position which was not detected as a detected vehicle position in the previous scanning but was so detected in the current scanning (FIG. 7, step 204), the height evaluator 38 first sets a height block number storage area in its incorporating memory, and then registers in the memory information that the number of height blocks is 1 (height block number=1) (206). As to a position which was detected as a detected vehicle position in the previous scanning but not so detected in the current scanning (208), the height evaluator 38 recognizes that the number of height blocks has been fixed, and informs the vehicle type detector 40 of the fixed number of height blocks registered in the height block number storage area and the height information obtained in step 202 (210).

Figures 9A, 9B:
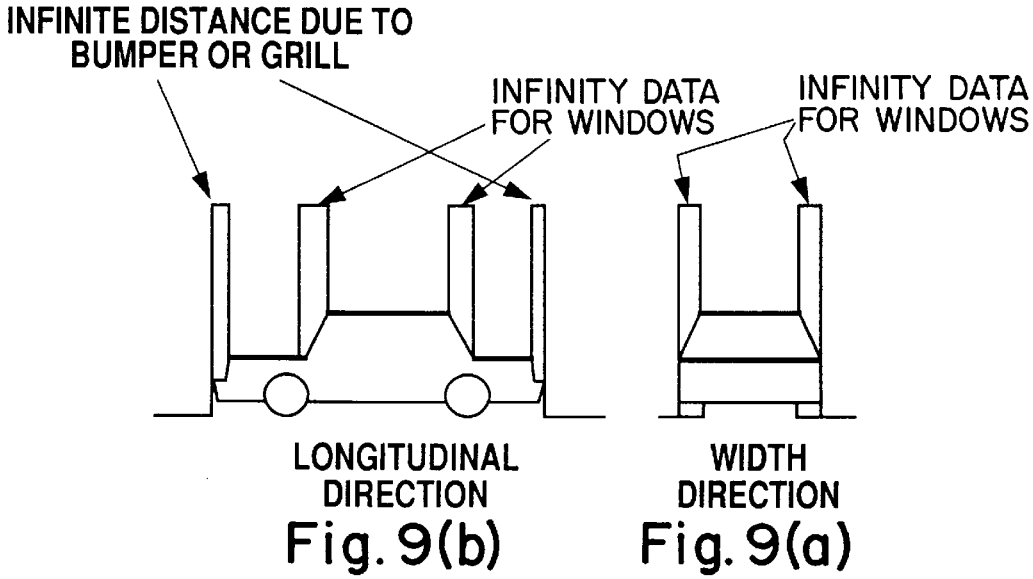
FIG. 9 is a diagram showing a position of occurrence of infinity data in an example of a 3 box passenger car.
Figure 16:
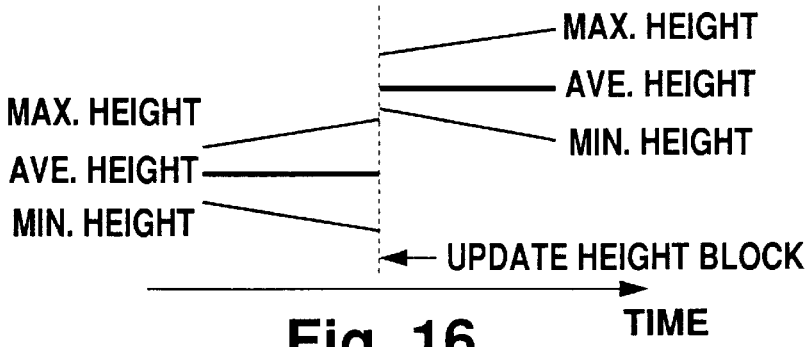
FIG. 16 is a timing chart showing height block edge timing based on maximum, minimum or average height.

As to a position which was detected as a detected vehicle position both in the previous and current scanning (212), the height evaluator 38 judges whether or not the linked height data obtained through the current scanning includes infinity data of more than a given ratio (214). If it is judged that it does, the height evaluator 38 either conducts step 214 and subsequent steps as to the remaining detected vehicle positions obtained through the current scanning, or returns to step 200 if no detected vehicle position remains. On the contrary, if it is judged that it does not, it can be assumed that most of the sections currently scanned are sections which reflect significant light (sections other than a front/rear window section, a bumper section, as shown in FIG. 9(*b*)). Thus, the scan-by-scan height evaluator 38 subsequently performs the same judgement as to the previously scanned height link data (216). If a positive judgement is then obtained, it is known that a new height block was detected in the current scanning. In other words, the scanning position is moved, such as from a front window to a roof, from the previous to current scanning. Therefore, the height evaluator 38 adds 1 to the height block number held in the incorporated memory (218). If a negative judgement is obtained at step 216, it is assumed that the current scanning was not able to detect a new height block. The height evaluator 38 thus, in general, performs the same operation after a positive judgement in step 214. However, if comparison of an average height, etc., between previous and current scanning proves a discontinuity between the previously and currently scanned linked height data, in other words, a significant change from the previous to current scanning (220), the scan-by-scan height evaluator 38 moves to step 218 instead.

It is to be noted that, in general, through the comparison of right edges, left edges and centers between previous and current scan, each of the detected vehicle positions in the current scan can correctly be correlated with one of the detected vehicle positions in the previous scan.

Next, the conditions (steps 214, 126, and 218) for applying step, that is, 218 will be described. That the increment of the number of height blocks. Refer to FIG. 12, in which the horizontal axis shows time, i.e., the road extending direction, and the vertical axis shows the value of linked height data. It is known from the drawing that only a minority of the linked height data obtained by scanning the sections indicated with arrows (a bonnet, a roof, a trunk, etc.) are infinity data, whereas the majority of linked height data obtained by scanning the other sections are finite data, as shown in the left half of FIG. 9 and FIG. 13. In this view, it is known that the section whose linked height data mostly includes infinity data, and the other section, appear alternately for a three-box car, or the like. The conditions imposed in steps 214 and 216 are for detection of this transitional point (indicated by an arrow in FIG. 14) from the former section (such as a front window) to the latter section (such as a roof).

Returning to step 202 (particularly step 308), the maximum, minimum, and average heights are calculated and held in the scan-by-scan height evaluator 38. These data are held for collecting sufficient data to be referred to in determining a pattern in which the maximum, minimum, and average heights of the sections with arrows in FIG. 12 have been varied along the road extending direction. This pattern information is used not only in determination of a vehicle type (described later) but also in height block detection in step 220. That is, height block detections at steps 214 and 216 are effective for discriminating among the first to third (from the top) types of vehicles in FIG. 15, wherein the first type is a three-box passenger car consisting of three height blocks connected to each other via a window, the second type is a one-box car or a bus consisting of one height block, and the third type is a two-box car consisting of two height blocks connected to each other via a window. However, these conditions are not effective in distinguishing the fourth type, that is, a truck consisting of two blocks directly connected to each other, from the other types (the truck in the drawing carries no load thereon). Therefore, according to the present invention, the condition imposed at step 220 is to detect an updating point for a height block, i.e., the dotted line in FIG. 16, based on height information.

The conditions applicable at step 220 may include a) when the maximum height for the current scanning is smaller than the minimum height for the previous scanning, i.e., the vehicle height varied significantly between the two scannings; b) when the minimum height for the current scanning is larger than the maximum height for the previous scanning, i.e., the vehicle height varied significantly between the two scannings; and c) when an average height for the current scanning which is larger than the maximum height or smaller than the minimum height as for the previous scanning, i.e., the vehicle height varied significantly between the two scannings.

d) Operation of Vehicle Type Detector

Figure 17:
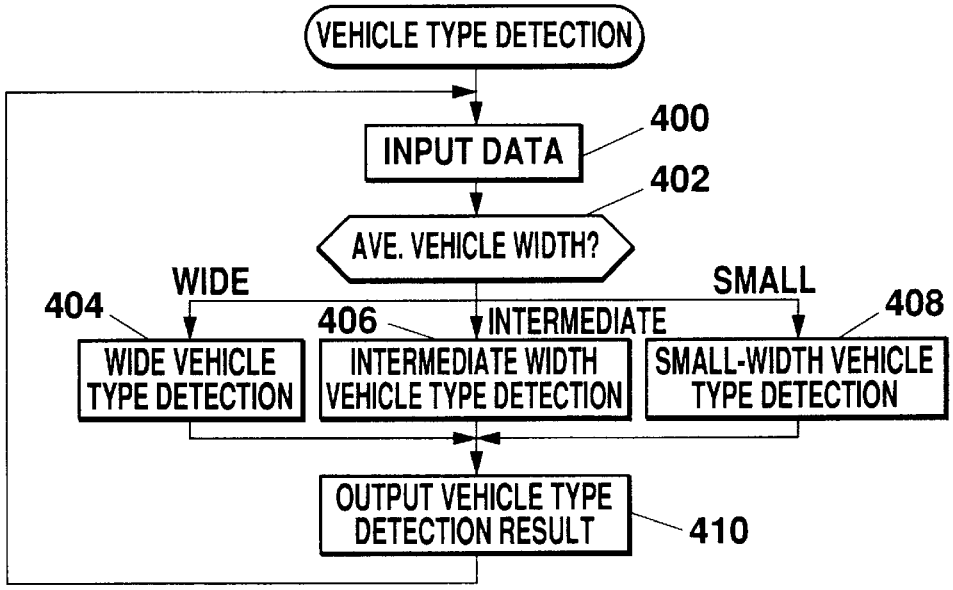
FIG. 17 is a flow chart showing a flow of vehicle type detection processing.

FIG. 17 shows the command operations of the vehicle type detector 40. The vehicle type detector 40 first receives data from the scan-by-scan height evaluator 38 (400), wherein the data includes one obtained by the scan-by-scan height evaluator 38 and one obtained by the vehicle detector 34 and supplied via the scan-by-scan height evaluator 38. Table 1 shows an example of data per one vehicle 24 to be supplied to the vehicle type detector 40 in step 400.

TABLE 1

| Input data to Vehicle Type Detector (per one vehicle) |
|---|
| Data obtained by scan-by-scan height evaluator |
| The number of height blocks of a vehicle |
| Maximum, minimum, and average heights obtained through every scanning of respective height blocks of a vehicle |
| Data obtained by vehicle detector |
| Right/left edge positions of a vehicle |
| Average center position of a vehicle |
| Maximum, minimum, and average vehicle widths |
| Time taken for a vehicle to pass a detection line (passing time) |

Based on the information regarding the average vehicle width, supplied from the vehicle detector 34 via the height data calculation section 38, the vehicle type detector 40 detects whether the objective vehicle 24 belongs to a wide, intermediate width, or small-width vehicle (402). The average vehicle width is obtained by averaging vehicle widths of the same vehicle obtained by successively scanning along the road extending direction. For instance, when the number of pixels which indicates an average vehicle width is less than a given value A, the objective vehicle 24 is judged as belonging to a small-width vehicle such as a motorbike. When the number is equal to or more than B+1 (B>A), the objective vehicle 24 is judged as belonging to a wide vehicle such as a large-size truck, a bus, a trailer truck, etc. In other cases where the number is equal to or more than A+1 and equal to or less than B, the objective vehicle 24 is judged as belonging to a intermediate width vehicle, including a passenger car, a small-size truck, a 4 WD vehicle.

TABLE 2

| Classification by Width | | |
|---|---|---|
| Width | Number of Pixels | Vehicle Types |
| wide | B + 1 or more | large-size truck, bus, trailer truck, etc. |
| inter-mediate | A + 1 to B | passenger car (three-box, two-box, one-box types), small-size truck, 4WD, etc. |
| small | less than A | motorbike, etc. |

The number of pixels is switchable using a parameter.

According to the judgement result at step 402, the vehicle detector 40 executes one of the operations at step 404 relative to wide vehicle detection, step 406 relative to intermediate width vehicle detection, or step 408 relative to small-width vehicle detection. After execution of a suitable step, the detector 40 outputs the operating result to the detection result transmission processor 36 (410), and then returns to step 400 to get ready for conducting vehicle type detection for another vehicle 24. The information output from the vehicle type detector 40 at step 410 includes vehicle width classification information which indicates a vehicle type among a wide, intermediate width, or small-width vehicle to which the objective vehicle 24 belongs to, and vehicle type information obtained as a result of steps 404, 406 or 408. This vehicle type information indicates e.g., whether the objective vehicle 24 is a truck or a bus.

TABLE 3

| Output data of vehicle type detector (per one vehicle) |
|---|
| Vehicle width classification - wide, intermediate, small |
| Vehicle type information |
| Truck |
| Bus |
| Passenger car (one-box) |
| Passenger car (two-box, 4WD) |
| Passenger car (three-box) |
| motorbike |
| unspecified |

Vehicle type detection at steps 404 to 408 will next be described based on a flowchart. Actually, the respective operations at these steps can be achieved through comparison between the data base held in the vehicle detector 40 regarding the number of height blocks and a threshold and the information shown in Table 1, particularly the data obtained by the scan-by-scan height evaluator 38.

Figure 18:
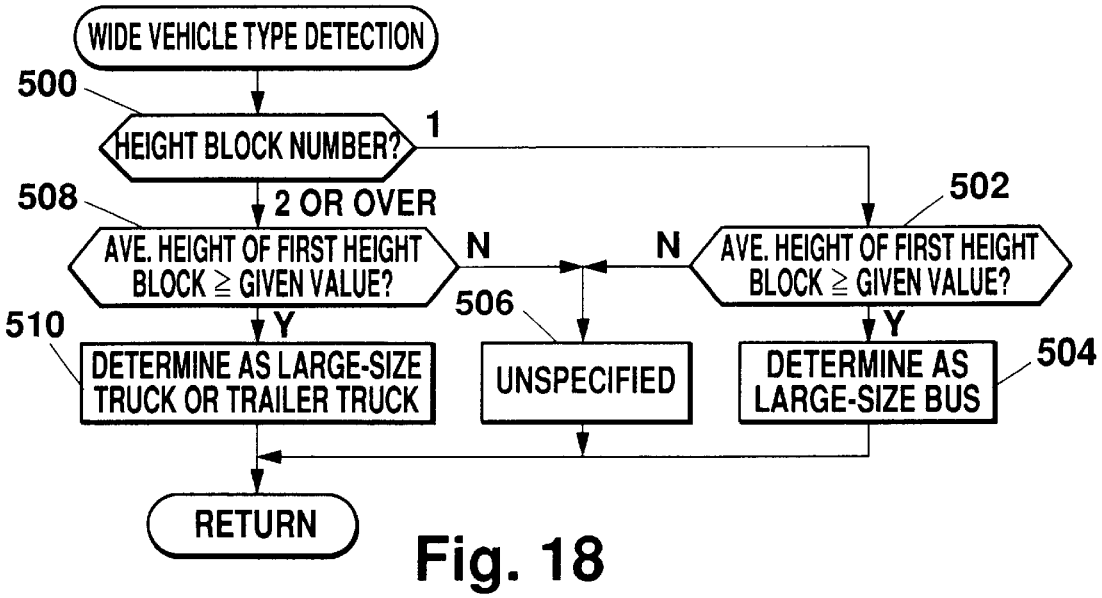
FIG. 18 is a flow chart showing a flow of wide vehicle detection processing.

FIG. 18 shows the operating content relative to a wide vehicle detection which is held at step 404. The vehicle type detector 40 first detects whether the number of the height blocks is 1 or 2 or over (500). With the number being 1, the objective vehicle 24 is possibly a one-box large-size vehicle, such as a large-size bus as shown in FIG. 19. Thus, the vehicle type detector 40 compares the average height of the height block of the objective vehicle 24 and a given threshold for a large-size bus (502). If the comparison proves that the average height is over the large-size bus threshold, the vehicle type detector 40 decides that the condition of FIG. 19 is met, and thus determines that the objective vehicle 24 is a large-size bus (504). On the contrary, if the comparison results proves otherwise, the vehicle type detector 40 generates information to the effect that the vehicle type of the vehicle 24 cannot be specified (506).

Returning to step 500, if the height block number is detected as equal to or more than 2, the objective vehicle 24 may be a large-size vehicle as shown in FIG. 20. Thus, the vehicle type detector 40 compares the average height of the first height block of this vehicle 24 and a given height threshold for a large-size truck head (508). If the comparison results proves that the average height is equal to or more than the large-size truck head height threshold, the vehicle type detector 40 decides that the objective vehicle 24 is a large-size truck or a trailer truck (510). In other words, the vehicle type detector 40 decides that the objective vehicle 24 meets either condition shown in FIG. 20. However, if it is judged that the average height is less than the large-size truck head height threshold, the vehicle type detector 40 generates vehicle type information to the effect that the type of the objective vehicle 24 cannot be specified (506).

Figure 21:
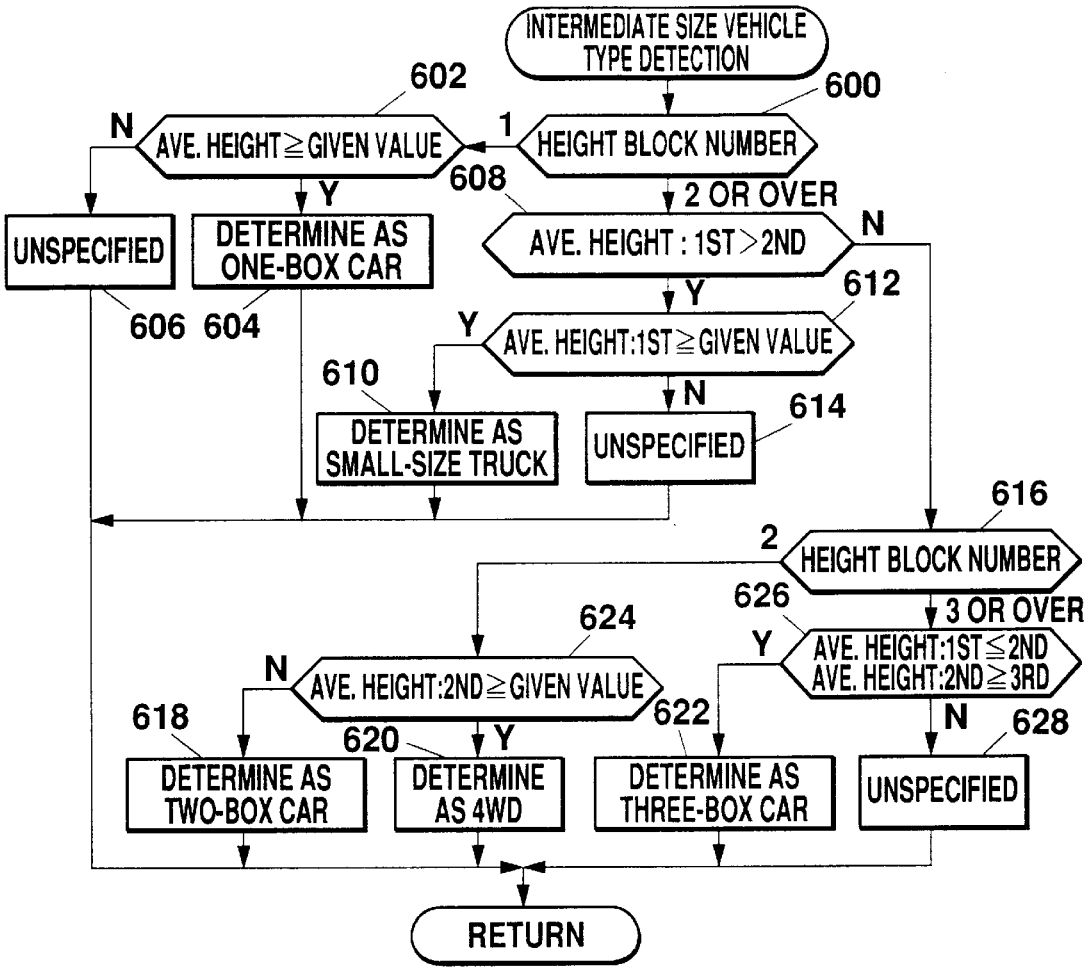
FIG. 21 is a flow chart showing a flow of intermediate width vehicle detection processing.
Figure 22:
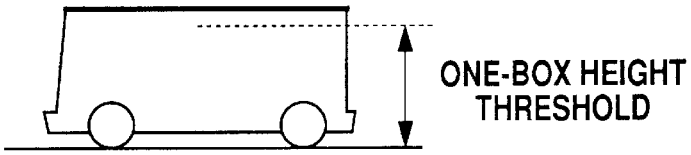
FIG. 22 is a schematic diagram showing a principle for detecting a one box car.

FIG. 21 shows the operating content of an intermediate width vehicle detection held at step 406. The vehicle type detector 40 first detects whether the number of the height blocks is 1 or 2 or over (600). With the number being 1, the objective vehicle 24 is possibly a one-box car. Then, the vehicle type detector 40 compares the average height of the height block of the objective vehicle 24 and a given threshold for a one-box car (602). If the comparison proves that the average height is larger than the one-box car threshold, it is recognized that the condition of FIG. 21 is met, and the vehicle type detector 40 thus determines that the objective vehicle 24 is a one-box car (604). On the contrary, if the comparison results turns out to be otherwise, the vehicle type detector 40 generates information to the effect that the vehicle type of the vehicle 24 cannot be specified (606).

Figure 23:
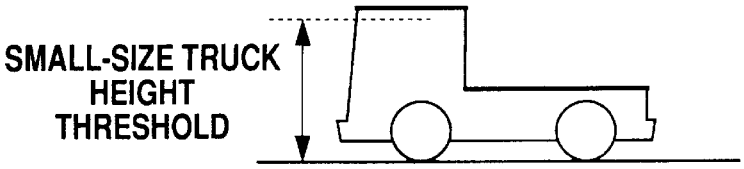
FIG. 23 is a schematic diagram showing a principle for detecting a small size truck.
Figure 24:
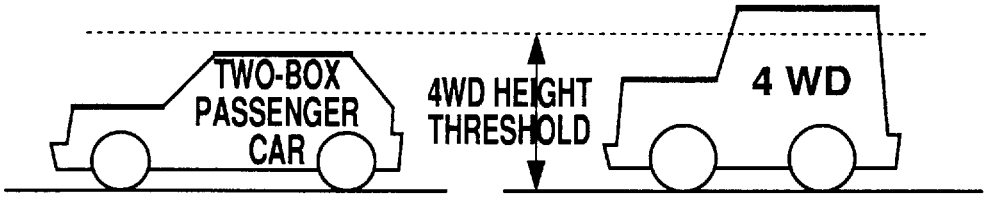
FIG. 24 is a schematic diagram showing a principle for detecting and discriminating a 2 box passenger car and a 4 WD car.
Figure 25:
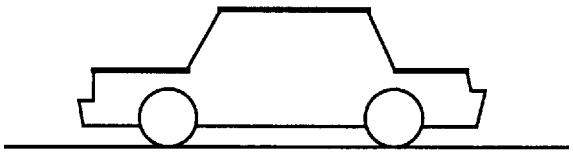
FIG. 25 is a schematic diagram showing a principle for detecting a 3 box car.

Returning to step 600, if the height block number is detected as equal to or more than 2, the objective vehicle 24 may be any one of a small-size truck as shown in FIG. 23, a two-box passenger car or a 4 WD car as shown in FIG. 24, or a three-box passenger car as shown in FIG. 25. Thus, the vehicle type detector 40 detects whether or not the average height of the first height block exceeds that of the second height block (608) to see if the objective vehicle 24 is a small-size truck or not. If a positive result is detected, the vehicle type detector 40, in principle, determines that the objective vehicle 24 is a small-size truck (610). However, there is an exception to this determination principle. That is, if the average height of the first height block which exceeds that of the second height block does not exceed a threshold for a given small-size truck, it is not reasonable to determine that the objective vehicle 24 is a small-size truck. Therefore, when the average height of the first height block is detected as being larger than that of the second height block, the vehicle type detector 40 detects whether or not the average height of the first height block exceeds a small-truck height threshold (612) prior to determining that the objective vehicle 24 is a small-size truck. If a negative result is obtained, the vehicle type detector 40 generates information of unspecified vehicle type (614).

Returning to step 608, if the average height of the first height block is detected as being smaller than that of the second height block, the vehicle type detector 40 detects whether or not the number of height blocks of the objective vehicle is 2 or 3 or over (616). In the case of the number being 2, the objective vehicle 24 may possibly be a two-box passenger car or a 4 WD car, and in the case of the number being 3 or over, the objective vehicle 24 may be a three-box passenger car as shown in FIG. 25. Therefore, the vehicle type detector 40 resorts to step 618 so as to discriminate between the above two possibilities, and determines that the objective vehicle 24 is a two-box passenger car or a 4 WD (618 and 620) when the number is 2, and a three-box passenger car (622) when the number is 3 or over.

For discrimination between a two-box passenger car and a 4 WD car, the vehicle type detector 40 resorts to a condition to see whether or not the average height of the second height block exceeds a given 4 WD height threshold. This condition utilizes the fact that a two-box passenger car is generally lower than a 4 WD car. Therefore, it is possible to discriminate between a two-box passenger car and a 4 WD car according to the principle shown in FIG. 24. In addition, even if the number of height blocks is detected as being equal to or more than 3 at step 616, when the average height of the first height block is higher than that of the second height block, or that of the second height block is lower than that of the third height block (626), the vehicle type detector 40 generates vehicle type information to the effect that the type cannot be specified (628). This is because the second height block of a three-box passenger car is generally higher than the height of any other height blocks. Utilizing this fact, step 628 prevents erroneous determination that an object or a vehicle which is not a three-box passenger car is judged as a three-box passenger car.

Referring to FIG. 17, when step 408 is conducted, the vehicle type detector 40 decides that the objective vehicle 24 is a motorbike.

It should be noted that the principles and conditions for vehicle type detection shown in FIGS. 18 to 25 are merely examples, and that other conditions may be additionally applied so as to achieve discrimination of a vehicle 24 in a peculiar shape, such as a construction vehicle. Further, the vehicle type may be detected according to an index other than an average height.

What is claimed is:

1. A vehicle type detecting system comprising:

height detecting means for detecting a height of an object on a road; and vehicle type detecting means for, when the height satisfies at least one of a plurality of vehicle type conditions, determining that the object is a vehicle which belongs to a vehicle type corresponding to said at least one of plurality of vehicle type conditions, each of said vehicle type conditions being defined for every vehicle type;

wherein said height detecting means includes a plurality of sensors each detecting a distance to the object, and means for, if any of the plurality of sensors becomes faulty, generating information representing the detection of distance from the faulty sensor.

2. A vehicle type detecting system according to claim 1, wherein the vehicle type detecting means further includes;

height profile detecting means for repeatedly detecting a height profile of the object by utilizing the height detecting means so as to obtain a plurality of height profiles along a direction crossing a lengthwise direction of a road with respect to the object;

pattern detecting means for detecting a pattern of variation of the plurality of height profiles detected from the object, along the lengthwise direction of the road; and means for, when the pattern satisfies at least one of said vehicle type conditions, determining that the object is a vehicle which belongs to a vehicle type corresponding to said at least one of said vehicle type conditions.

3. A vehicle type detecting system according to claim 2, wherein the pattern detecting means further includes:

means for generating a statistical index for each of a plurality of height profiles detected from the object, the statistical index representing distribution of height in the object; and means for gathering generated statistical indexes with respect to the object and for detecting the pattern by comparing gathered statistical indexes with each other along the lengthwise direction of the road.

4. A vehicle type detecting system according to claim 3, wherein the pattern detecting means further includes:

means for detecting a number of height profiles beyond a height detection limit from the plurality of height profiles detected from the object; and means for detecting the pattern on the number of height profiles beyond the height detection limit.

5. A vehicle type detecting system according to claim 2, wherein the pattern detecting means further includes:

means for detecting a number of height profiles beyond a height detection limit from the plurality of height profiles detected from the object; and means for detecting the pattern on the basis of the number of height profiles beyond the height detection limit.

6. A vehicle type detecting system according to claim 1, wherein said information representing the detection of distance from the faulty sensor is generated by another of said plurality of sensors in proximity of the faulty sensor.

7. A vehicle type detecting system according to claim 1, wherein at least some of said plurality of sensors are operated with a different timing so as to prevent interference among said sensors.

8. A vehicle type detecting system comprising:

height detecting means for detecting a height of an object on a road; and vehicle type detecting means for, when the height satisfies at least one of a plurality of vehicle type conditions, determining that the object is a vehicle which belongs to a vehicle type corresponding to said at least one of a plurality of vehicle type conditions, each of said vehicle type conditions being defined for every vehicle type;

wherein the vehicle type detecting means includes:

height profile detecting means for repeatedly detecting a height profile of the object by utilizing the height detecting means so as to obtain a plurality of height profiles along a direction crossing in a lengthwise direction of the road with respect to the object;

pattern detecting means for detecting a pattern of variation of the plurality of height profiles detected from the object, along the lengthwise direction of the road; and means for, when the pattern satisfies at least one of said vehicle type conditions, determining that the object is a vehicle which belongs to a vehicle type corresponding to said at least one of said vehicle type conditions; wherein the height detecting means includes:

a plurality of sensors arranged along the direction crossing the lengthwise direction with a required small interval, the plurality of sensors each detecting the distance to an object passing its neighborhood and supplying detected results to the height profiles detecting means; and means for, if any of the plurality of sensors goes faulty, generating information representing estimated distance on the basis of the detected result by another sensor located in the proximity of the faulty sensor, and supplying the information to the height profile detecting means instead of the distance to be detected by the faulty sensor.

9. A vehicle type detecting method comprising:

a step of detecting a height of an object on a road using a plurality of sensors detecting a distance to the object and, if any of the plurality of sensors becomes faulty, generating information representing the detection of distance from the faulty sensor; and a step of, when the height satisfies at least one of a plurality of vehicle type condition, determining that the object is a vehicle which belongs to a vehicle type corresponding to said at least one of a plurality of vehicle type condition, each of said vehicle type conditions being defined for each of vehicle types.

10. A vehicle type detecting method according to claim 9, wherein said information representing the detection of distance from the faulty sensor is generated by another of said plurality of sensors in proximity of the faulty sensor.

11. A vehicle type detecting method according to claim 9, comprising a step of operating at least some of said plurality of sensors with a different timing so as to prevent interference among said sensors.

12. A debiting system comprising:

a system for receiving identification information from a vehicle running on a road by radio communication with the vehicle and for generating a first vehicle type information representing a vehicle type of the vehicle on the basis of the received identification information;

a vehicle type detecting system detecting a height of an object on the road, determining, when the height satisfies at least one of a plurality of vehicle type conditions, that the object is a vehicle which belongs to a vehicle type corresponding to said at least one of a plurality of vehicle type conditions, and generating second vehicle type information showing determined results, each of said vehicle type conditions being defined for each of vehicle types; and a host system for detecting a vehicle transmitting the identification information, which does not coincide with an actual vehicle type of the vehicle, by matching the first vehicle type information with the second vehicle type information;

wherein said vehicle type detecting system includes a plurality of sensors each detecting a distance to the object, and means for, if any of the plurality of sensors becomes faulty, generating information representing the detection of distance from the faulty sensor.

13. A debiting system according to claim 12, wherein said information representing the detection of distance from the faulty sensor is generated by another of said plurality of sensors in proximity of the faulty sensor.

14. A debiting system according to claim 12, wherein at least some of said plurality of sensors are operated with a different timing so as to prevent interference among said sensors.

15. A vehicle type detecting system comprising:

height detecting means for detecting a height of an object on a road; and vehicle type detecting means for, when the height satisfies at least one of a plurality of vehicle type conditions, determining that the object is a vehicle which belongs to a vehicle type corresponding to said at least one of a plurality of vehicle type conditions, each of said vehicle type conditions being defined for every vehicle type;

wherein said height detecting means includes a plurality of sensors, at least some of said plurality of sensors operating with a different timing so as to prevent interference among said sensors.

16. A vehicle type detecting system according to claim 15, wherein the vehicle type detecting means includes:

height profile detecting means for repeatedly detecting a height profile of the object by utilizing the height detecting means so as to obtain a plurality of height profiles along a direction crossing a lengthwise direction of a road with respect to the object;

pattern detecting means for detecting a pattern of variation of the plurality of height profiles detected from the object, along the lengthwise direction of the road; and means for, when the pattern satisfies at least one of said vehicle type conditions, determining that the object is a vehicle which belongs to a vehicle type corresponding to said at least one of said vehicle type conditions.

17. A vehicle type detecting system according to claim 16, wherein the pattern detecting means includes:

means for generating a statistical index for each of a plurality of height profiles detected from the object, the statistical index representing distribution of height in the object; and means for gathering generated statistical indexes with respect to the object and for detecting the pattern by comparing gathered statistical indexes with each other along the lengthwise direction of the road.

18. A vehicle type detecting system according to claim 17, wherein the pattern detecting means includes:

means for detecting a number of height pro files beyond a height detection limit from the plurality of height profiles detected from the object; and means for detecting the pattern on the number of height profiles beyond the height detection limit.

19. A vehicle type detecting system according to claim 16, wherein the pattern detecting means includes:

means for detecting a number of height profiles beyond a height detection limit from the plurality of height profiles detected from the object; and means for detecting the pattern on the basis of the number of height profiles beyond the height detection limit.

20. A vehicle type detecting system comprising:

height detecting means for detecting a height of an object on a road;

vehicle type detecting means for, when the height satisfies at least one of a plurality of vehicle type conditions, determining that the object is a vehicle which belongs to a vehicle type corresponding to said at least one of a plurality of vehicle type conditions, each of said vehicle type conditions being defined for every vehicle type; and width detecting means for detecting a width of the object;

wherein said width detecting means detects the entire width of the object and said vehicle type detecting means rejects height data from said height detecting means indicating an infinite height if said height data indicating an infinite height occupies less than a predetermined ratio with respect to the entire width of the object.

21. A vehicle type detecting system according to claim 20, wherein said vehicle type detecting means utilizes height data indicating an infinite height from said height detecting means if said height data indicating an infinite height occupies more than said predetermined ratio.

* * * * *